US006899602B2

(12) United States Patent
Fawcett et al.

(10) Patent No.: US 6,899,602 B2
(45) Date of Patent: May 31, 2005

(54) POROUS POLYURETHANE POLISHING PADS

(75) Inventors: Clyde A. Fawcett, Claymont, DE (US); T. Todd Crkvenac, Hockessin, DE (US); Kenneth A. Prygon, Bear, DE (US); Bernard Foster, Elkton, MD (US)

(73) Assignee: Rohm and Haas Electronic Materials CMP Holdings, NC, Wilmington, DE (US)

( * ) Notice: Subject to any disclaimer, the term of this patent is extended or adjusted under 35 U.S.C. 154(b) by 0 days.

(21) Appl. No.: 10/630,255

(22) Filed: Jul. 30, 2003

(65) Prior Publication Data

US 2005/0026552 A1 Feb. 3, 2005

(51) Int. Cl.[7] ..... B24B 1/00

(52) U.S. Cl. ..... 451/57; 451/41; 451/921; 451/58

(58) Field of Search ..... 451/41, 28, 530, 451/56, 58, 57, 921; 438/692, 693; 51/296

(56) References Cited

U.S. PATENT DOCUMENTS

| | | | | |
|---|---|---|---|---|
| 3,284,274 A | | 11/1966 | Hulslander et al. | |
| 6,062,968 A | * | 5/2000 | Sevilla et al. | 451/526 |
| 6,117,000 A | * | 9/2000 | Anjur et al. | 451/526 |
| 6,126,532 A | * | 10/2000 | Sevilla et al. | 451/526 |
| 6,284,114 B1 | * | 9/2001 | Chechik et al. | 204/483 |
| 6,439,965 B1 | | 8/2002 | Ichino et al. | |

OTHER PUBLICATIONS

Rodel® Finishing Pads; Rodel® Brochure, Rev. 3.0; Feb. 1, 2002, Rodel, Inc., Newark, DE.

* cited by examiner

*Primary Examiner*—George Nguyen
(74) *Attorney, Agent, or Firm*—Blake T. Biederman

(57) ABSTRACT

A porous polishing pad is useful for polishing semiconductor substrates. The porous polishing pad has a porous matrix formed from a coagulated polyurethane and a non-fibrous polishing layer. The non-fibrous polishing layer has a polishing surface with a pore count of at least 500 pores per $mm^2$ that decreases with removal of the polishing layer; and the polishing surface has a surface roughness Ra between 0.01 and 3 $\mu$m.

11 Claims, 3 Drawing Sheets

POROUS POLYURETHANE POLISHING PADS

BACKGROUND OF THE INVENTION

The present invention relates to porous polyurethane polishing pads useful for polishing semiconductor substrates and a method of using the polishing pad. In addition, it relates to a method for forming the porous polishing pads.

In recent years, the requirements for integrated circuit fabrication and the drive toward ever higher circuit densities have made it critical that the surfaces of integrated circuit substrates (e.g., silicon wafers) and magnetic substrates (e.g., nickel-plated disks for memory applications) be polished to increasingly higher degrees of smoothness. The present state of the art for achieving the smoothest surface involves polishing the substrate using a polishing solution and a polishing pad.

One polishing technique for achieving a highly polished surface involves using a porous polishing pad in combination with a polishing slurry or reactive liquid. The porous polishing pad must be firm enough to provide the necessary polishing action while also being porous enough to hold the aqueous slurry or reactive liquid.

The most widely used materials for porous polishing pads are taken from a class of materials known as poromerics. Poromerics are textile-like materials having a multitude of pores or cells. Typically, the pores are formed using urethane-based impregnation or a porous coating layer. One method of forming poromeric pad material involves a solvent/non-solvent coagulation process. An example of such a process is described in U.S. Pat. No. 3,284,274 to Hulslander et al.

FIG. 1 is a close-up schematic cross-sectional view of a typical state-of-the-art poromeric polishing pad 6. Pad 6 has a top layer 10 with an upper surface 15. The top layer 10 contains cells 20 having a diameter anywhere from a few microns to several hundred microns.

The walls 30 of cells 20 can be solid, but more typically the walls are made up of microporous sponge. In a conditioned poromeric polishing pad 6, a large portion of cells 20 are open to surface 15 and form pores 35 therein.

Because the top poromeric layer 10 tends to be mechanically fragile, it is typically fixed on a substrate 40 such as a plastic film (e.g., Mylar™ polyethylene terephthalate film), heavy paper or a woven or non-woven textile (e.g., felt), sometimes by means of an adhesive.

To manufacture the poromeric layer 10 for pad 6 of FIG. 1, it is customary to coat a solution of polymer onto a substrate and then immerse the coated substrate into a bath that causes coagulation of the polymer. Once the polymer has been fully coagulated, the remaining solvent is leached out and the product dried.

Because of the nature of the coagulation process, cells 20 tend to increase in diameter as they penetrate deeper into the material. Also, a thin skin-layer (not shown) forms on the upper surface 15 of layer 10. The diameters of pores 35 at or near surface 15 are relatively small compared to the underlying cell diameters and get larger as material is removed from surface 15 during buffing. Likewise, the pore count at or near the (original) surface 15 is greater than when the pad is buffed down to create a new upper surface.

It is generally believed that having a pore count between 100 and 325 pores per $mm^2$ is important to the polishing process. Specifically, it is believed that such a pore count allows the pad to carry (via cells 20) a large amount of slurry to the wafer (workpiece). To this end, the conventional poromeric pad polishing practice is to avoid a polishing surface with porosity. Typically, the number of pores per unit area, referred to as the "pore count," is used to describe the polishing layer's porosity at the polishing surface. For purposes of this specification pore count refers to the average number of pores detectable per $mm^2$ at an optical magnification of 50× on the polishing surface. A specific example of computer software useful for counting and processing pore data is Image-Pro Plus software, Version 4.1.0.1. The pore count is proportional to the (average) pore diameter, i.e., the higher the pore count, the smaller the average pore diameter.

This practice of maintaining sufficient pore size also eliminates several other detrimental side effects. For example, small pores make the pad short-lived because dross and spent slurry tend to clog the pores or get stuck in the underlying cells. Further, small pores can make it difficult to keep slurry flowing in and out of the cells. The dross can also become impacted in the cell and ultimately ends the cell's ability to carry slurry. Further, associated with small pores is a relatively high percentage of the pad surface area being composed of cell walls. This results in a high wiping friction while also decreasing the presentation of fresh slurry to the workpiece. In addition, at the end of the polishing cycle, it is a customary operating practice to rinse the substrate with pure water while the workpiece is still in the polishing environment. Relatively small cell openings take longer to flush the slurry out of the cells and replace it with fresh water.

It is customary therefore as part of the poromeric pad fabrication process to buff down the top layer by a distance D1 ranging from 4 to 6 mils in order to form the desired polishing surface. This buffing is performed immediately after the pad is fabricated. The result is a polishing surface 50 (dashed line) having a much larger pore size and smaller pore density than unbuffed surface 15. For example, polishing surface 50 has an average pore size between 100 and 325 pores per $mm^2$, while the original surface did not contain any porosity.

The second step of a two-step polishing process for patterned semiconductor wafers typically forms a planarized surface after a bulk-removal polishing step. There is an ever-increasing demand to lower pad-induced defects during second-step and other CMP process steps for patterned wafers. In addition, there is an ongoing requirement for a process of producing polishing pads that further reduces defects in comparison to conventional porous polyurethane pads.

STATEMENT OF THE INVENTION

The invention provides a porous polishing pad useful for polishing semiconductor substrates, the porous polishing pad having a porous matrix formed from a coagulated polyurethane and a non-fibrous polishing layer, the non-fibrous polishing layer having a polishing surface with a pore count of at least 500 pores per $mm^2$, the pore count decreasing with removal of the polishing layer and the polishing surface having a surface roughness Ra between 0.01 and 3 $\mu$m.

In addition, the invention provides a method of preparing a porous polishing pad formed from a coagulated polyurethane, the porous polishing pad being useful for polishing semiconductor substrates, comprising: supporting the porous polishing pad with a platen, the porous polishing pad having an upper surface and pore count per $mm^2$ that decreases below the upper surface; applying a cutting tool to the upper surface of the top porous layer; and removing the upper surface with the cutting tool to provide a polishing surface of a polishing layer having a surface roughness Ra between 0.01 and 3 $\mu$m and the polishing layer being non-fibrous and the polishing surface having a pore count of at least 500 pores per $mm^2$ that decreases with removal of the polishing layer.

Furthermore, the invention provides a method of polishing a semiconductor substrate including the step of polishing the semiconductor substrate with a porous polishing pad, the porous polishing pad having a porous matrix formed from a coagulated polyurethane and a non-fibrous polishing layer, the non-fibrous polishing layer having a polishing surface with a pore count of at least 500 pores per $mm^2$ and a surface roughness Ra between 0.01 and 3 $\mu$m.

DETAILED DESCRIPTION OF THE INVENTION

Figure 1:
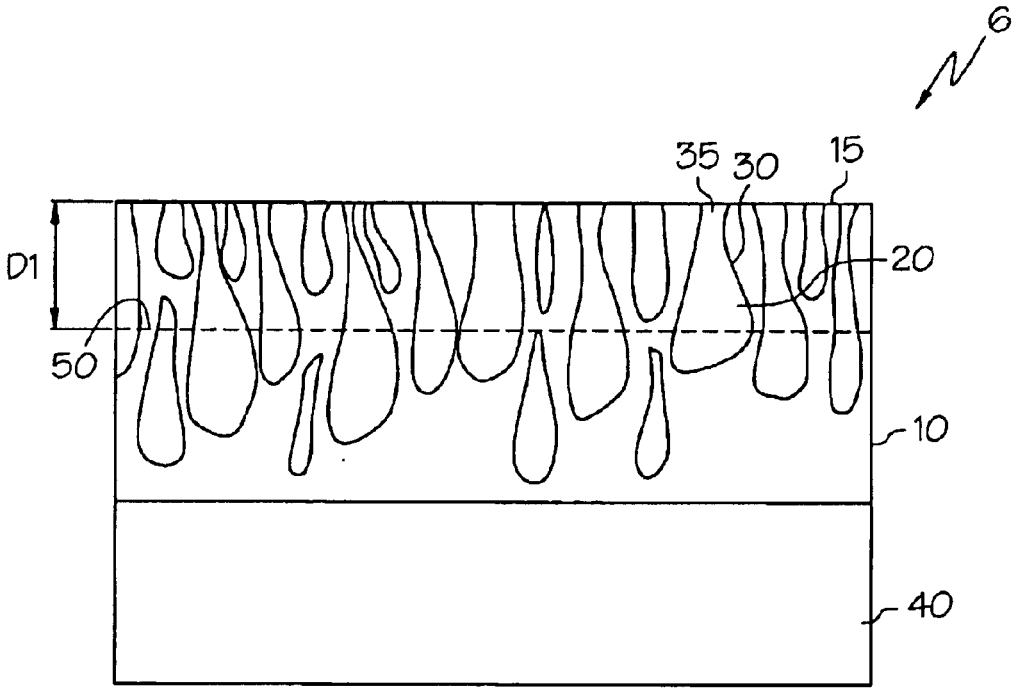
FIG. 1 (PRIOR ART)
FIG. 1 is a schematic cross-sectional diagram of a poromeric polishing pad, illustrating the prior art distance D1 to which the top layer is buffed down to ensure a relatively large pore size at the polishing surface of the pad.

The coagulated polyurethane polishing pad's structure appears to have a particular efficacy for reducing pad-induced defects in electronics industry substrates such as, semiconductor wafers, patterned semiconductor wafers, silicon wafers, glass and metal disks. In particular, the polishing pads are useful for second-step or finishing steps for patterned silicon wafers, such as, inter layer dielectric, barrier removal, shallow trench isolation, copper-low k, copper-ultra-low k wafers, tungsten and other substrate materials used to manufacture integrated circuits. The polishing pad has a structure that appears to be most advantageous for long-life-low-defectivity polishing of difficult to polish substrates, such as low k and ultra-low k dielectrics and the second step of a two-step polishing process.

The porous polishing pads have a porous matrix formed with a coagulated polyurethane polymer. Advantageously, the porous polymer includes polyurethane. Most advantageously, the porous polishing pads have a coagulated polyurethane matrix. The coagulated matrix most advantageously forms from coagulating a polyetherurethane polymer with polyvinyl chloride. It is possible to deposit the coagulated matrix on a felt-type or a film-based matrix, such as a Mylar™ porous matrix has a non-fibrous polishing layer. For purposes of this specification, polishing layer is that portion of the polishing pad capable of contacting a substrate during polishing; and a non-fibrous polishing layer is a polishing layer that does not incorporate fibers, such as a woven or felt structure. This non-fibrous structure has a contiguous structure that usually has a pore count per square millimeter that decreases below the upper surface. Although a closed cell or non-reticulated structure is acceptable, most advantageously, this structure is an open or reticulated cell structure containing micro-porous openings that connect the cells. The micro-porous reticulated structure allows gas flow through the pores, but limits slurry penetration into the polishing pad to maintain a more uniform polishing pad thickness during polishing.

Unlike pore counts of earlier polishing pads, the polishing surface has a pore count of at least 500 pores per $mm^2$. This high pore count yields a small pore size that can improve defectivity performance without a detrimental decrease in polishing rate. This high pore count is particularly effective for abrasive-free solutions, such as reactive liquids and slurries containing only an incidental amount of abrasives. Advantageously, the polishing surface has a pore count of 500 to 10,000 pores per $mm^2$. Most advantageously, the polishing surface has a pore count of 500 to 2,500 pores per $mm^2$.

The polishing layer has a pore count per unit area that decreases with removal of the polishing layer. The decreasing pore count or increasing pore size improves consistency with the coagulation process and has limited affect upon polishing performance. For example, a pore count may decrease by at least 50 percent over a distance of 5 mils (0.13 mm) inward from the polishing surface and have no significant impact upon the polishing pad's polishing performance. Furthermore, the polishing pads' resiliency and durability facilitate extended polishing life with minimal detrimental impact from increasing pore size. For planarizing and finishing patterned wafers, it is possible to use polishing pads that maintain within limited pore count range during polishing.

In addition to the polishing surface's controlled porosity, the polishing surface also advantageously contains a surface roughness (Ra) between 0.01 and 3 $\mu$m. Most advantageously, the polishing surface's roughness (Ra) is between is between 0.1 and 2 $\mu$m. Generally, increasing surface roughness improves polishing rate, but decreases defectivity; and decreasing surface roughness improves defectivity, but decreases polishing rate.

The method of preparing a porous polishing pad useful for polishing semiconductor substrates first includes the step of supporting the porous polishing pad with a platen. For purposes of the specification, a platen is a plate structure having a planar top surface. Most advantageously, the supporting the platen constitutes attaching it to a rotary type apparatus for chemical mechanical planarization for disk-shaped polishing pads. This provides the advantages of providing a high planarity surface and polishing directly after producing the finished surface. This process can improve the polishing pad's global planarity in relation to conventional buffed or sanded polishing pads. For belt-shaped or web-type designs, the platen may comprise a metal plate, such as a stainless steel plate that only supports a portion of the polishing pad. Then applying a cutting tool to the upper surface of the top porous layer on a periodic basis produces the finished polishing surface.

Removing the upper surface with the cutting tool provides the polishing layer having the desired surface roughness and porosity. For disk-shaped polishing pads, a single platen supports the entire polishing pad to allow a single removal step. But for belt-shaped polishing pads, the process advantageously includes periodic indexing of the polishing pad over a platen to remove the top surface from the entire polishing pad.

Figure 2:
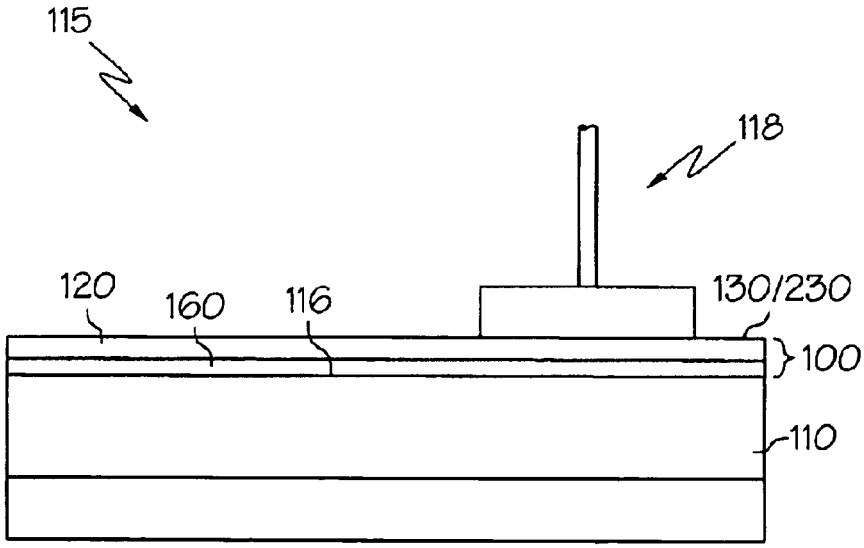
FIG. 2 is a schematic cross-sectional view of a poromeric polishing pad arranged on the platen of a polishing apparatus and having a cutting tool in contact with the polishing pad surface.

Referring to FIG. 2, porous polishing pad 100 is arranged on a platen 110 of an apparatus 115. In an example embodiment, polishing apparatus 115 is a chemical mechanical planarizing (CMP) apparatus. Platen 110 has an upper surface 116. Apparatus 115 also includes a cutting tool 118 operable to engage polishing pad 100.

Figure 3:
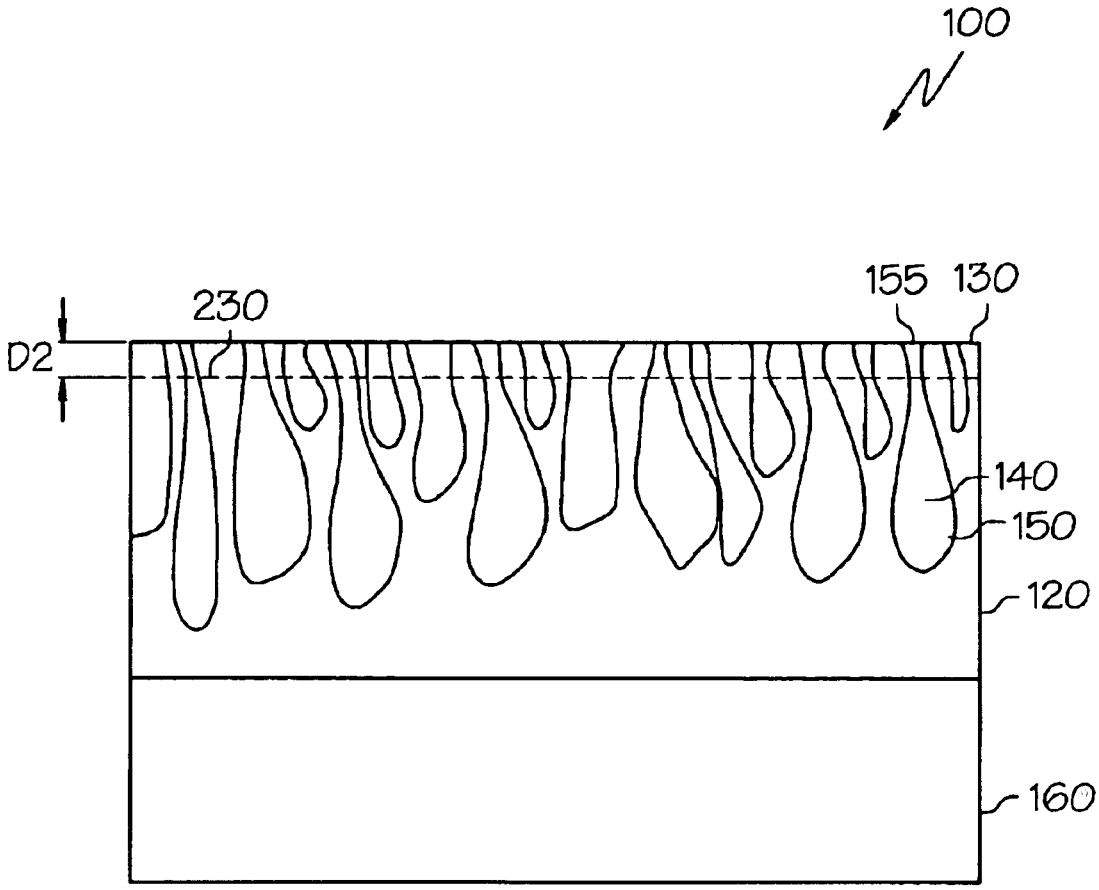
FIG. 3 is a schematic cross-sectional view of a poromeric polishing pad of FIG. 2, illustrating the method of the present invention whereby the top layer of the polishing pad is buffed down a distance D2 from its original surface while on the platen prior to polishing a substrate.

Referring to FIGS. 2 and 3, pad 100 has a top polishing layer 120 with a surface 130. The polishing layer 120 contains cells 140 having a pore count of at least 500 pores per $mm^2$. Walls 150 of cells 140 can be solid, but most advantageously the walls are made up of microporous sponge. A large portion of cells 140 is open to surface 130 and form pores 155 therein. In an example embodiment, polishing layer 120 is fixed to a substrate 160 such as a plastic film (e.g., Mylar™ polyethylene terephthalate), heavy paper or a woven or non-woven textile, e.g., by means of an adhesive. The most common substrate 160 currently used is a non-woven felt impregnated with a filler or binder to give it strength, dimensional stability and the required degree of cushioning or firmness.

The polishing layer 120 is formed by coating a solution of polymer onto substrate 160 and then immersing the coated substrate into a bath that causes coagulation of the polymer. Once the polymer has been fully coagulated, the remaining solvent is leached out and the product dried.

Pad 100 has polishing layer 120 that has not been buffed or sanded down a distance D1 of 4 to 6 mils (0.1 to 0.15 mm) prior to being placed on platen 110 of polishing apparatus 115. Rather, pad 100 is placed on platen 110 without any surface removal or preparation. Cutting tool 118, such as a diamond conditioning head, is then placed in contact with surface 130. Cutting tool 118 is then activated (i.e., moved relative to surface 130 while contacting the surface) to remove only a small amount of surface material from top layer 120. In an example embodiment, top layer 120 is buffed down from its original surface 130 a distance D2 of less than 4 mils (0.1 mm). Most advantageously, the distance D2 is between 0.5 and 1.5 mils (0.012 to 0.038 mm). This in-situ removal results in a polishing surface 230 having a relatively high pore count of between 500 and 2,500 pores per mm 2.

EXAMPLE

Comparative examples A, B and C represent porous polishing pads produced by coagulating polyurethane and sanding off the top layer with a belt sanding device—these pads represent commercially available POLITEX™ high, regular and low nap height polishing pads sold by Rodel, Inc. POLITEX™ polishing pads and the polishing pad of the example were porous-non-fibrous polishing pads produced by coagulating polyurethane; and in particular, coagulating a polyetherurethane polymer with polyvinyl chloride produces these pads.

The following example 1 represents the process used to prepare polishing pads from the non-sanded polishing material of the comparative examples to have a unique combination of high pore count and excellent surface roughness. First, cleaning the platen with isopropyl alcohol prepared the polishing platen. Then mounting the pad to the cleaned polishing platen with minimal trapped air prepared the blank pad for machining. Then cutting the pad on the platen using deionized water and a diamond cutting tool removed the top layer of the pad to leave a polishing layer. The cutting conditions were as follows: platen speed 100 rpm; diamond cutting disk size 100 mm or 4 inch outer diameter (medium to high cut rate type), diamond cutting tool speed 100 rpm with a down force of 14 lb (96 kPa). The specific diamond-cutting disk was Kinik Part No. AD3CG 181060 containing cubic-octahedral diamonds, a 180 $\mu$m diamond size a 100 $\mu$m diamond protrusion and a 600 $\mu$m diamond spacing designed for an AMAT tool type.

This process required between 50 and 300 bi-directional sweeps, depending on the desired pore size. Each bi-directional sweep was broken down into the following 20 segments by seconds (s) per sweep: (1) 1.6 seconds; (2) 1.1 s; (3–18) 0.6 s; (19) 1.1 s; 1.6 s with a deionized water rinse. The following Table compares the results achieved with the comparative examples.

| Property | Example 1 | Comparative Example A | Comparative Example B | Comparative Example C |
|---|---|---|---|---|
| Pores/$mm^2$ | 1,500 | 305 | 223 | 136 |
| Pad Thickness (mm) | 0.86 | 0.86 | 0.86 | 0.86 |
| Vertical Pore Height (mm) | 0.23 | 0.23 | 0.25 | 0.23 |
| Roughness Ra ($\mu$m) | 0.69 | 6.70 | 8.30 | 11.78 |
| Roughness Rq ($\mu$m) | 1.02 | 8.56 | 10.69 | 14.87 |

Figure 4:
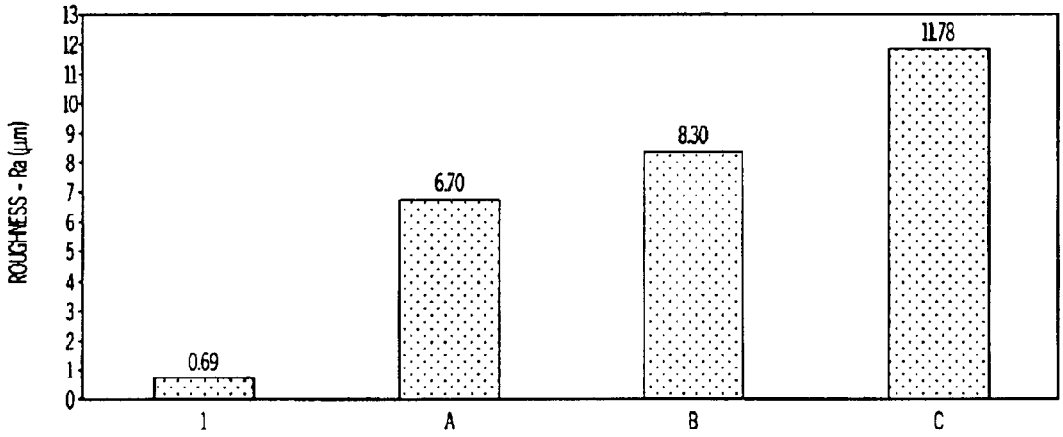
FIG. 4 is a bar graph that illustrates the improvement in surface roughness achieved with the polishing pads of the invention.

The above data indicate that the high pore density and improved surface roughness achieved. Furthermore, FIG. 4 charts the low surface roughness Ra achieved with the polishing pads. In particular, the polishing surface 230 is more amenable for polishing a substrate to a high degree of smoothness than conventional porous pads. In particular, the smaller pores and higher pore density of polishing surface 230 can allow for substrates (e.g., wafers) to be polished with decreased defectivity, decreased surface roughness and improved planarization. This is of great importance for polishing patterned semiconductor substrates, such as forming thin gate oxides and polishing low k dielectric/copper damascene structures in integrated circuit manufacturing. Furthermore, the polishing pads can reduce pad-induced defects in comparison to conventional porous polyurethane pads.

The porous polishing pad advantageously has a pore count per unit area ($mm^2$) that decreases below the polishing layer. Despite the decreasing pore count, the polishing pad has an extended pad life that can maintain the polishing surface's pore count of at least 500 pores per $mm^2$ for at least 50 patterned wafers. Because of the pad's excellent life, cleaning the pad has increased importance for extending pad life. In view of this, the additional step of conditioning the porous polishing pad with a polymeric brush or polymeric pad can clean the pad to further extend the pad's life. Conditioning with a polymeric pad or brush facilitates debris removal without the excessive increase in pore size that diamond conditioners provide.

The polishing pad appears to have a particular efficacy for reducing pad-induced defects in semiconductor substrates, silicon wafers, glass and metal disks. In particular, the polishing pads are useful for patterned semiconductor wafers such as, the second step of a two-step polishing process or other finish polishing steps that remove a last portion of excess material or planarize to a near-flat or final flatness.

What is claimed is:

1. A method of polishing a patterned semiconductor substrate including the step of polishing the semiconductor substrate with a porous polishing pad, the porous polishing pad having a porous matrix formed from a coagulated polyurethane and a non-fibrous polishing layer, the non-fibrous polishing layer having a polishing surface with a pore count of at least 500 pores per $mm^2$ and the pore count (per $mm^2$) decreases below the polishing layer and a surface roughness Ra between 0.01 and 3 $\mu$m and maintaining the polishing surface with the pore count of at least 500 pores per $mm^2$ for at least 50 patterned wafers.

2. The method of claim 1 including the additional step of conditioning the porous polishing pad with a polymeric brush or polymeric pad.

3. The method of claim 1 wherein the polishing occurs with a surface, roughness Ra between 0.1 and 2 $\mu$m.

4. The method of claim 1 including the additional step of applying a cutting tool to the upper surface.

5. The method of claim 4 wherein the applying a cutting tool includes pressing a diamond conditioning head against the upper surface.

6. A method of polishing a patterned semiconductor substrate including the step of polishing the semiconductor substrate with a porous polishing pad, the porous polishing pad having a porous matrix formed from a coagulated polyurethane and a non-fibrous polishing layer, the non-fibrous polishing layer having a polishing surface with a pore count of at least 500 pores per $mm^2$ and the pore count (per $mm^2$) decreases below the polishing layer and a surface roughness Ra between 0.01 and 3 $\mu$m and maintaining the polishing surface with the pore count of 500 to 10,000 pores per $mm^2$ for at least 50 patterned wafers.

7. The method of claim 6 wherein the porous polishing pad maintains a pore count of 500 to 2,500 pores per $mm^2$ for at least 50 patterned wafers.

8. The method or claim 6 including the additional stop of conditioning the porous polishing pad with a polymeric brush or polymeric pad.

9. The method of claim 6 wherein the polishing occurs with a surface roughness Ra between 0.1 and 2 $\mu$m.

10. The method of claim 6 including the additional step of applying a cutting tool to the upper surface.

11. The method of claim 10 wherein the applying a cutting tool includes pressing a diamond conditioning head against the upper surface.

* * * * *